US010497304B2

(12) United States Patent
Yano et al.

(10) Patent No.: US 10,497,304 B2
(45) Date of Patent: Dec. 3, 2019

(54) DISPLAY UNIT, IMAGE PROCESSING DEVICE, DISPLAY METHOD, AND ELECTRONIC APPARATUS FOR CONTROLLING LUMINANCE

(71) Applicant: Sony Corporation, Tokyo (JP)

(72) Inventors: Tomoya Yano, Kanagawa (JP); Yohei Funatsu, Kanagawa (JP); Yasuo Inoue, Tokyo (JP)

(73) Assignee: Sony Corporation, Tokyo (JP)

( * ) Notice: Subject to any disclaimer, the term of this patent is extended or adjusted under 35 U.S.C. 154(b) by 299 days.

(21) Appl. No.: 14/106,484

(22) Filed: Dec. 13, 2013

(65) Prior Publication Data

US 2014/0176620 A1 Jun. 26, 2014

(30) Foreign Application Priority Data

Dec. 21, 2012 (JP) ..... 2012-278832

(51) Int. Cl.
*G09G 3/3208* (2016.01)

(52) U.S. Cl.
CPC ..... *G09G 3/3208* (2013.01)

(58) Field of Classification Search
None
See application file for complete search history.

(56) References Cited

U.S. PATENT DOCUMENTS 6,236,750 B1 * 5/2001 Garber ..... G06T 11/001 382/162
6,788,812 B1 * 9/2004 Wilkins ..... 382/167
2005/0184944 A1 * 8/2005 Miyata et al. ..... 345/89
2005/0285828 A1 * 12/2005 Inoue et al. ..... 345/76
2008/0144963 A1 * 6/2008 Lin ..... H04N 9/77 382/274
2008/0186413 A1 * 8/2008 Someya ..... H04N 5/20 348/739
2009/0122207 A1 * 5/2009 Inoue ..... G09G 3/2025 348/739
2012/0249610 A1 * 10/2012 Katagami ..... G09G 3/3426 345/690
2013/0120471 A1 * 5/2013 Lin ..... G09G 3/342 345/690
2015/0123985 A1 * 5/2015 Abe ..... G06T 5/008 345/590

FOREIGN PATENT DOCUMENTS

JP 4293747 B2 4/2009
JP 4434935 B2 1/2010

* cited by examiner

*Primary Examiner* — William Boddie
*Assistant Examiner* — Alecia D English
(74) *Attorney, Agent, or Firm* — Chip Law Group

(57) ABSTRACT

An image processing device includes a control section configured to determine, based on first luminance information for each display pixel, frame luminance information in a single frame and current information. The current information indicates a magnitude of a current that is expected to be consumed in displaying the single frame on a display section. The control section is configured to control, based on the frame luminance information and the current information, light-emitting luminance of the display section.

19 Claims, 13 Drawing Sheets

DISPLAY UNIT, IMAGE PROCESSING DEVICE, DISPLAY METHOD, AND ELECTRONIC APPARATUS FOR CONTROLLING LUMINANCE

CROSS REFERENCE TO RELATED APPLICATIONS

This application claims the benefit of Japanese Priority Patent Application JP 2012-278832 filed on Dec. 21, 2012, the entire contents of which are incorporated herein by reference.

BACKGROUND

The present disclosure relates to a display unit for displaying images, an image processing device and a display method that are in use for such a display unit, and an electronic apparatus that includes such a display unit.

In recent years, a substitution of a liquid crystal display unit or an organic EL (Electro-Luminescence) display unit for a CRT (Cathode Ray Tube) display unit has been progressing. Such a display unit has been becoming the mainstream of a display unit because of its capability to reduce power consumption as well as to configure a low-profile display unit as compared with the CRT display unit.

In a display unit, high image quality is typically desired. One of various factors for determining the image quality is the contrast. For example, Japanese Patent No. 4293747 discloses an organic EL display unit that achieves high contrast and suppresses any overcurrent in organic EL display elements, wherein each pixel is configured of three sub-pixels of red (R), green (G), and blue (B). In this display unit, for example, a current flowing through all the pixels (total pixel current) is detected, and a control is carried out in a manner of decreasing a pixel luminescence time in the case of the large total pixel current, and increasing the pixel luminescence time in the case of the small total pixel current. In such a manner, for example, when the light-emitting area is small on a display screen, the total pixel current is small, and thus a control is carried out to increase a luminescence period of time, thereby achieving high contrast. On the other hand, for example, when the light-emitting area is large on a display screen, the total pixel current is large, and thus a control is carried out to decrease the luminescence period of time, thereby suppressing any overcurrent in organic EL display elements.

Meanwhile, there may be some display units in which each pixel is composed of four sub-pixels. For example, Japanese Patent No. 4434935 discloses an organic EL display unit that reduces power consumption in such a manner that each pixel is configured of sub-pixels of red (R), green (G), blue (B), and white (W). In this display unit, for example, when a white color is to be displayed, power consumption is reduced by making a sub-pixel of white (W) luminescent mainly instead of, for example, three sub-pixels of red (R), green (G), and blue (B).

SUMMARY

As described above, in a display unit, high image quality such as high contrast, as well as reduced power consumption are typically desired. In particular, in an organic EL display unit, it has been desired to protect organic EL display elements in a manner of, for example, suppressing any overcurrent in the organic EL display elements, and to reduce any deterioration in the image quality that is caused by degradation in the characteristics of the organic EL display elements.

It is desirable to provide a display unit, an image processing device, a display method, and an electronic apparatus that allow the high image quality and reduced power consumption to be achieved.

According to an embodiment of the present disclosure, there is provided a display unit (1) including: a display section including a plurality of display pixels; and a control section configured to determine, based on first luminance information for each of the display pixels, frame luminance information in a single frame and current information, the current information indicating a magnitude of a current that is expected to be consumed in displaying the single frame on the display section, and control, based on the frame luminance information and the current information, light-emitting luminance of the display section.

According to an embodiment of the present disclosure, there is provided a display unit (2) including: a display section including a plurality of display pixels; and a control section configured to control light-emitting luminance of the display section to allow a total pixel current of the display pixels to be increased with an increase in S information in an HSV color space when the S information is equal to or less than a predetermined value, the S information being derived from luminance information for each of the display pixels, and to allow the total pixel current to be substantially constant when the S information is equal to or more than the predetermined value.

According to an embodiment of the present disclosure, there is provided an image processing device including: a control section configured to determine, based on first luminance information for each display pixel, frame luminance information in a single frame and current information, the current information indicating a magnitude of a current that is expected to be consumed in displaying the single frame on a display section, and control, based on the frame luminance information and the current information, light-emitting luminance of the display section.

According to an embodiment of the present disclosure, there is provided a display method including: determining, based on first luminance information for each display pixel, frame luminance information in a single frame and current information, the current information indicating a magnitude of a current that is expected to be consumed in displaying the single frame on a display section; and controlling, based on the frame luminance information and the current information, light-emitting luminance of the display section.

According to an embodiment of the present disclosure, there is provided an electronic apparatus provided with a display unit and a control section configured to perform a control of operation on the display unit. The display unit includes: a display section including a plurality of display pixels; and a control section configured to determine, based on first luminance information for each of the display pixels, frame luminance information in a single frame and current information, the current information indicating a magnitude of a current that is expected to be consumed in displaying the single frame on the display section, and control, based on the frame luminance information and the current information, light-emitting luminance of the display section.

Examples of the electronic apparatus may include a television receiver, a digital camera, a personal computer, and mobile terminal apparatuses such as a video camera or a mobile phone.

In the display unit (1), the image processing device, the display method, and the electronic apparatus according to the above-described respective embodiments of the present disclosure, an image is displayed on the display section. On this occasion, the frame luminance information and the current information are determined on the basis of the first luminance information for each of the display pixels, and the light-emitting luminance of the display section is controlled on the basis of the frame luminance information and the current information.

In the display unit (2) according to the above-described embodiment of the present disclosure, an image is displayed on the display section. On this occasion, the light-emitting luminance of the display section is controlled such that the total pixel current increases with the increase in the S information when the S information is not more than a predetermined value, and that the total pixel current becomes substantially constant when the S information is not less than the predetermined value.

In the display unit (1), the image processing device, the display method, and the electronic apparatus according to the above-described respective embodiments of the present disclosure, the light-emitting luminance is controlled on the basis of the frame luminance information and the current information. Therefore, it is possible to allow the high image quality and reduced power consumption to be achieved.

In the display unit (2) according to the above-described embodiment of the present disclosure, the light-emitting luminance of the display section is controlled to allow the total pixel current to be increased with the increase in the S information when the S information is equal to or less than a predetermined value, and to allow the total pixel current to be substantially constant when the S information is equal to or more than the predetermined value. Therefore, it is possible to allow the high image quality and reduced power consumption to be achieved.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification. The drawings illustrate embodiments and, together with the specification, serve to explain the principles of the present technology.

DETAILED DESCRIPTION

Hereinafter, some embodiments of the present disclosure are described in details with reference to the drawings. It is to be noted that the description is provided in the order given below.

1. First Embodiment
2. Second Embodiment
3. Application Examples (1. First Embodiment)

[Configuration Example]

(Overall Configuration Example)

Figure 1:
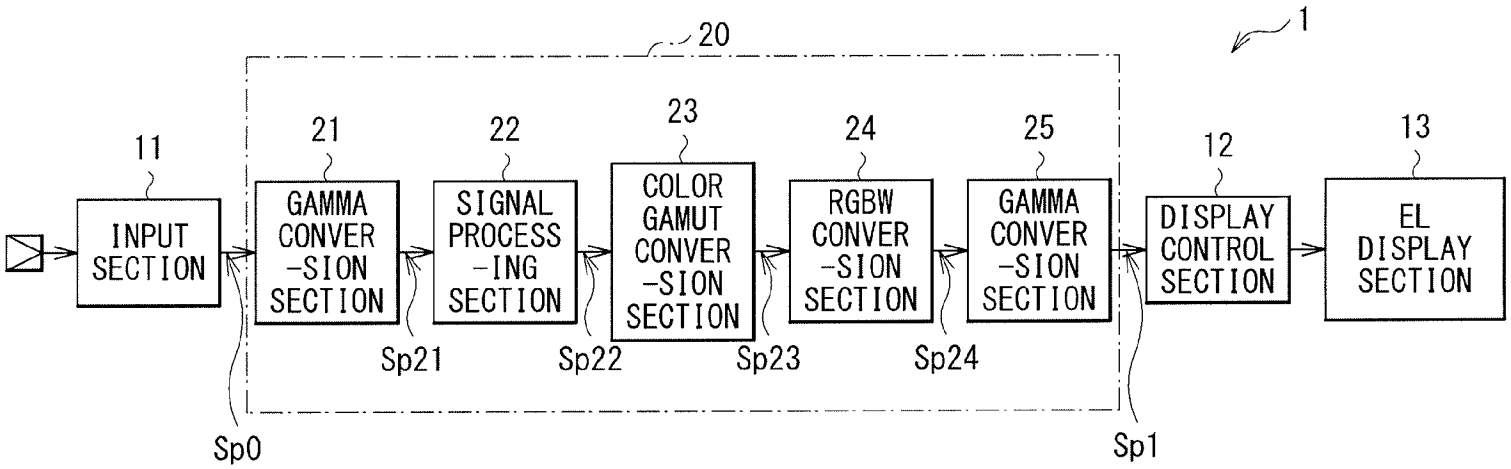
FIG. 1 is a schematic block diagram showing a configuration example of a display unit according to a first embodiment of the present disclosure.

FIG. 1 shows a configuration example of a display unit according to a first embodiment of the present disclosure. This display unit 1 is an EL display unit using organic EL display elements as display elements. It is to be noted that an image processing device and a display method according to embodiments of the present disclosure are also described together because they are embodied with this embodiment of the present disclosure. The display unit 1 includes an input section 11, an image processing section 20, a display control section 12, and an EL display section 13.

The input section 11, which is an input interface, generates an image signal Sp0 in accordance with an image signal provided from an external apparatus. An image signal to be provided for the display unit 1 may be, in this example, a so-called RGB signal including red (R) luminance information IR, green (G) luminance information IG, and blue (B) luminance information IB.

As described later, the image processing section 20 performs a predetermined image processing operation for the image signal Sp0, such as a processing for expanding the peak luminance (peak luminance expansion processing), a processing for adjusting the image contrast (contrast adjustment processing), and a processing for suppressing any overcurrent in organic EL display elements on the EL display section 13 (overcurrent suppression processing), thereby generating an image signal Sp1.

The display control section 12 performs a timing control of a display operation in the EL display section 13 in accordance with the image signal Sp1. The EL display section 13, which is a display section using organic EL display elements as display elements, carries out a display operation under control of the display control section 12.

Figure 2:
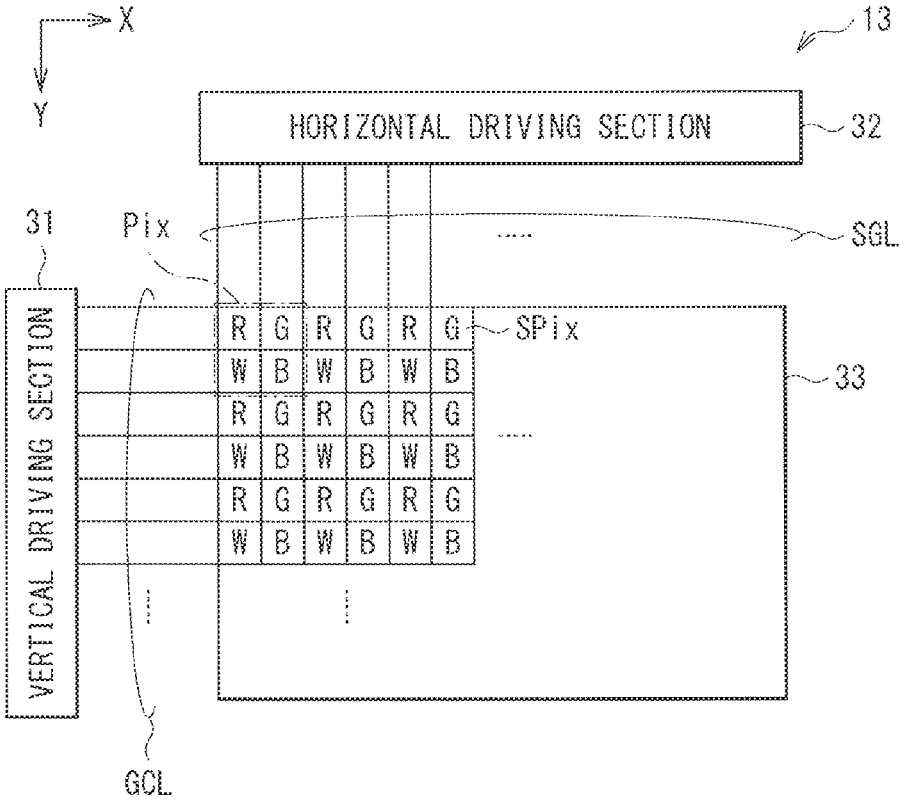
FIG. 2 is a schematic block diagram showing a configuration example of an EL display section illustrated in FIG. 1.

FIG. 2 shows a configuration example of the EL display section 13. The EL display section 13 has a pixel array section 33, a vertical driving section 31, and a horizontal driving section 32.

On the pixel array section 33, pixels Pix are arranged in a matrix pattern. In this example, each of the pixels Pix may be configured of four sub-pixels SPix of red (R), green (G), blue (B), and white (W). In this example, in the pixel Pix, these four sub-pixels SPix may be arranged in a two-row-two-column pattern. In concrete terms, in the pixel Pix, the sub-pixel SPix of red (R) may be arranged at the upper left, the sub-pixel SPix of green (G) may be arranged at the upper right, the sub-pixel SPix of white (W) may be arranged at the lower left, and the sub-pixel SPix of blue (B) may be arranged at the lower right.

It is to be noted that colors of the four sub-pixels SPix are not limited to these ones. For example, instead of the white sub-pixel SPix, a sub-pixel SPix of any other color with the visibility as high as a white color may be used alternatively. More specifically, it may be preferable to use a sub-pixel SPix of any other color (for example, yellow and the like) with the visibility equivalent to or higher than a green color that exhibits the highest visibility among a red color, a green color, and a blue color.

The vertical driving section 31 generates scan signals under a timing control of the display control section 12, and provides such scan signals to the pixel array section 33 via gate lines GCL, thereby sequentially selecting the sub-pixels SPix within the pixel array section 33 for each line to carry out a line sequential scanning. The horizontal driving section 32 generates pixel signals under a timing control of the display control section 12, and provides such pixel signals to the pixel array section 33 via data lines SGL, thereby providing the pixel signal to each of the sub-pixels SPix within the pixel array section 33.

The display unit 1 displays images using four sub-pixels SPix in such a manner. This makes it possible to reduce power consumption. In other words, for example, a display unit having three sub-pixels of red, green, and blue may make these three sub-pixels luminescent in the case of displaying a white color, while the display unit 1 may make the white sub-pixel luminescent mainly as an alternative, which allows power consumption to be reduced.

Further, the display unit 1 displays images using four sub-pixels SPix, which makes it possible to extend a color gamut that is allowed to be displayed as described below.

Figure 3A:
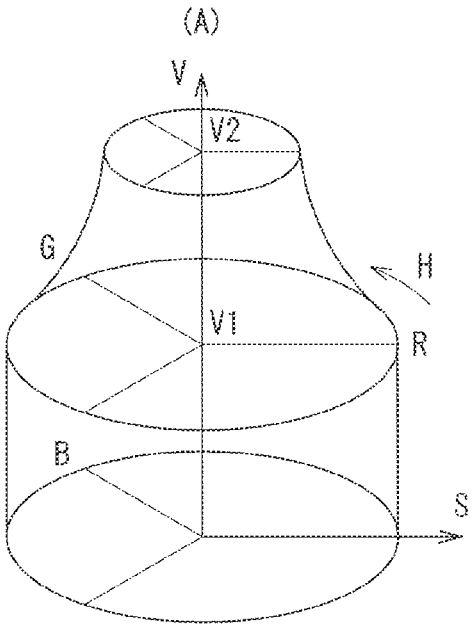
FIGS. 3A and 3B are each a schematic diagram showing an HSV color space.
Figure 3B:
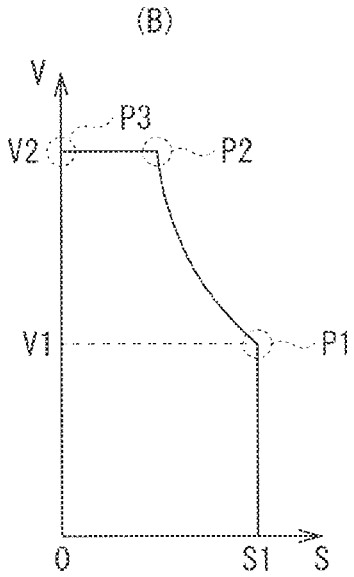
Figure 4A:
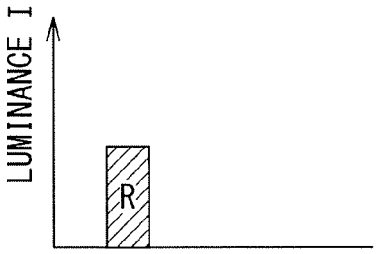
FIGS. 4A, 4B, and 4C are each an explanatory diagram showing an example of luminance information.

Each of FIGS. 3A and 3B shows a color gamut of the display unit 1 using an HSV color space, wherein FIG. 3A is a perspective view, and FIG. 3B is a cross-sectional view. In this example, the HSV color space is represented in a cylindrical shape, and in FIG. 3A, a radial direction denotes the saturation S (hereinafter also referred to as the color saturation degree), an azimuthal direction denotes the hue H, and an axial direction denotes the value V. In this example, FIG. 3B shows a cross-sectional view in the hue H representing a red color. Each of FIGS. 4A to 4C shows an example of a light-emitting operation in the pixel Pix on the display unit 1.

For example, in making only the red sub-pixel SPix luminescent, in FIG. 3B, it is possible to represent a color within a range of the saturation S of S1 or less and the value V of V1 or less. As illustrated in FIG. 4A, in making only the sub-pixel SPix of red (R) luminescent at the maximum luminance, a color corresponds to a portion P1 in FIG. 3B (saturation S="S1", value V="V1") in the HSV color space. The same is true for a green color and a blue color. In other words, in FIG. 3A, a range of a color that is allowed to be represented using three sub-pixels SPix of red, green, and blue falls into a lower half of the cylindrical shape (range within the value V of V1 or less).

Figure 4B:
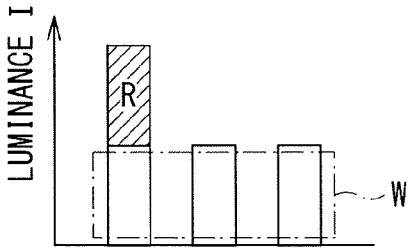
Figure 4C:
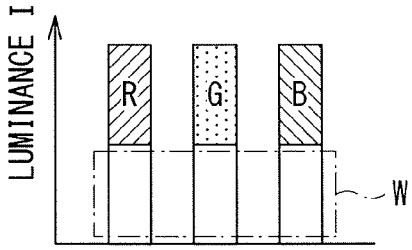

On the contrary, as illustrated in FIG. 4B, in making each of the sub-pixels SPix of red (R) and white (W) luminescent at the maximum luminance, a color corresponds to a portion P2 in FIG. 3B in the HSV color space. Further, as illustrated in FIG. 4C, in making each of the four sub-pixels SPix of red (R), green (G), blue (B), and white (W) luminescent at the maximum luminance, a color corresponds to a portion P3 in FIG. 3B in the HSV color space. In other words, by making the white sub-pixel SPix luminescent, it is possible to raise the value V at V2 higher than V1.

As described above, it is possible to extend a color gamut that is allowed to be represented by providing the white sub-pixel SPix in addition to the sub-pixels SPix of red, green, and blue. In concrete terms, for example, where the luminance at the time when making all the three sub-pixels SPix of red (R), green (G), and blue (B) luminescent at the maximum luminance and the luminance at the time when making the white sub-pixel SPix at the maximum luminance are equivalent to one another, it is possible to achieve the twofold luminance as compared with the case where the three sub-pixels SPix of red (R), green (G), and blue (B) are provided.

(Image Processing Section 20)

The image processing section 20 has a gamma conversion section 21, a signal processing section 22, a color gamut conversion section 23, an RGB conversion section 24, and a gamma conversion section 25.

The gamma conversion section 21 converts the incoming image signal Sp0 into an image signal Sp21 having the linear gamma characteristics. In other words, an image signal to be provided from outside, a gamma value of which may be set at, for example, about 2.2 and the like in conformity with typical characteristics of a display unit, has the nonlinear gamma characteristics. Consequently, to facilitate the processing at the image processing section 20, the gamma conversion section 21 converts such nonlinear gamma characteristics into the linear gamma characteristics. The gamma conversion section 21 may have, for example, a lookup table, and carries out such a gamma conversion using this lookup table.

The signal processing section 22 performs the peak luminance expansion processing, the contrast adjustment processing, and the overcurrent suppression processing for the pieces of luminance information IR, IG, and IB that are included in the image signal Sp21, thereby generating an image signal Sp22.

Figure 5:
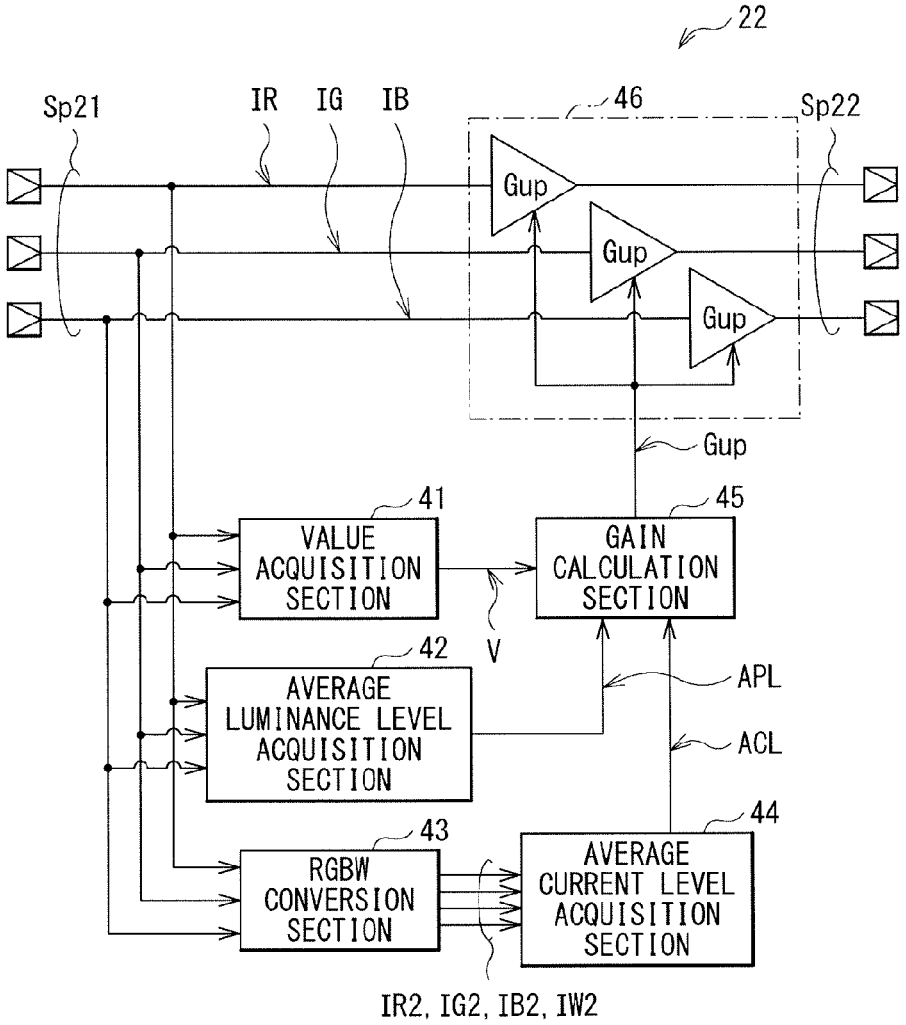
FIG. 5 is a schematic block diagram showing a configuration example of a signal processing section illustrated in FIG. 1.

FIG. 5 shows a configuration example of the signal processing section 22. The signal processing section 22 has a value acquisition section 41, an average luminance level acquisition section 42, an RGBW conversion section 43, an average current level acquisition section 44, a gain calculation section 45, and a multiplier section 46.

The value acquisition section 41 acquires the value V in the HSV color space from the pieces of luminance information IR, IG, and IB that are included in the image signal Sp21. It is to be noted that, in this example, the value acquisition section 41 is intended to acquire the value V in the HSV color space, although the configuration is not limited thereto. Alternatively, for example, the value acquisition section 41 may be configured to acquire the luminance L in an HLS color space, or may be configured to allow the acquisition of the value or the luminance to be selected.

The average luminance level acquisition section 42 determines and outputs an average value (average luminance level APL) of the pieces of luminance information IR, IG, and IB in a frame image. It is to be noted that, in this example, the average luminance level acquisition section 42 is intended to determine an average value of the pieces of luminance information IR, IG, and IB, although the configuration is not limited thereto. Alternatively, for example, the average luminance level acquisition section 42 may convert an RGB signal into an HSV signal to determine an average value of the value V in the HSV color space, or may convert the RGB signal into the HLS signal to determine an average value of the luminance L in the HLS color space.

The RGBW conversion section 43 generates an RGBW signal on the basis of the image signal Sp21 that is an RGB signal. In concrete terms, the RGBW conversion section 43 converts the RGB signal including the pieces of luminance information IR, IG, and IB for three colors of red (R), green (G), and blue (B) into the RGBW signal including the pieces of luminance information IR2, IG2, IB2, and IW2 for four colors of red (R), green (G), blue (B), and white (W).

Figure 6:
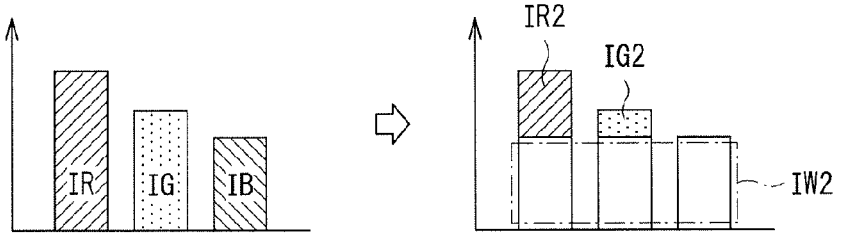
FIG. 6 is an explanatory diagram showing an operation example of an RGBW conversion section illustrated in FIG. 5.

FIG. 6 schematically shows an operation example of the RGBW conversion section 43. First, the RGBW conversion section 43 uses the minimum information (luminance information IB in this example) among the pieces of incoming luminance information IR, IG, and IB for three colors as the luminance information IW2. Subsequently, the RGBW conversion section 43 determines the luminance information IR2 by subtracting the luminance information IW2 from the luminance information IR, the luminance information IG2 by subtracting the luminance information IW2 from the luminance information IG, and the luminance information IB2 (zero in this example) by subtracting the luminance information IW2 from the luminance information IB. Thereafter, the RGBW conversion section 43 outputs the pieces of luminance information IR2, IG2, IB2, and IW2 that are determined in such a manner as the RGBW signal. It is to be noted that a method for the RGBW conversion is not limited thereto. For example, the pieces of luminance information IR2, IG2, IB2, and IW2 may be corrected in consideration of the luminescence characteristics for each of the sub-pixels SPix. More specifically, for example, when a luminescent color of the white sub-pixel SPix does not match with an intended white color, the pieces of luminance information IR2, IG2, IB2, and IW2 may be corrected to compensate for such a mismatch.

The average current level acquisition section 44 determines and outputs an average value of a current (average current level ACL) that is assumed to flow through each organic EL display element when the EL display section 13 displays a frame image. More specifically, the average current level acquisition section 44 determines an average value of a current which should flow through the organic EL display elements for all the sub-pixels SPix in the EL display section 13 in accordance with the RGBW signal including the pieces of luminance information IR2, IG2, IB2, and IW2 for four colors that are provided from the RGBW conversion section 43, and outputs the result as the average current level ACL.

The gain calculation section 45 calculates a gain Gup on the basis of the value V for each pixel that is provided from the value acquisition section 41, the average luminance level APL for each frame image that is provided from the average luminance level acquisition section 42, and the average current level ACL for each frame image that is provided from the average current level acquisition section 44.

Figure 7:
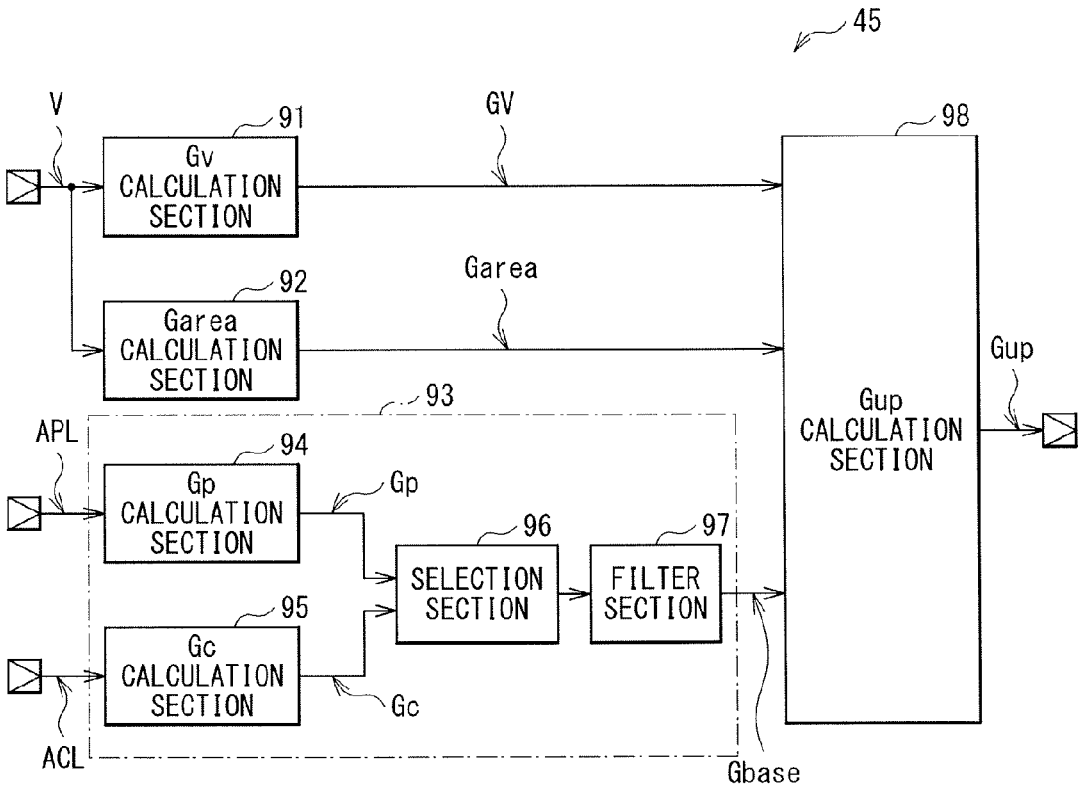
FIG. 7 is a schematic block diagram showing a configuration example of a gain calculation section illustrated in FIG. 5.

FIG. 7 shows a configuration example of the gain calculation section 45. The gain calculation section 45 has a Gv calculation section 91, a Garea calculation section 92, a Gbase calculation section 93, and a Gup calculation section 98.

The Gv calculation section 91 calculates a parameter Gv for each pixel on the basis of the value V. As described later, the parameter Gv is used for the peak luminance expansion processing, and is derived by a function on the basis of the value V.

Figure 8:
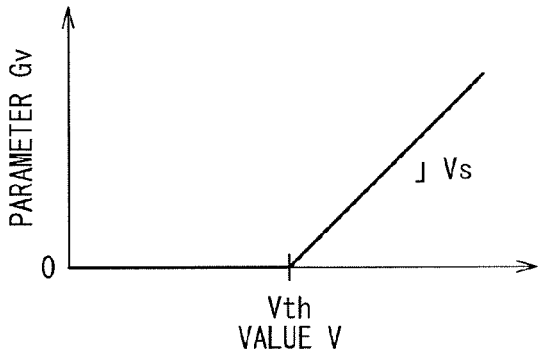
FIG. 8 is an explanatory diagram showing a characteristic example of a Gv calculation section illustrated in FIG. 7.

FIG. 8 shows a function for determining the parameter Gv. In this function, in this example, the parameter Gv becomes 0 (zero) when the value V is not more than a threshold Vth, and the parameter Gv increase as a linear function with a slope Vs when the value V is not less than the threshold Vth. In other words, this function is specified with two parameters (threshold Vth and slope Vs). In such a manner, the parameter Gv becomes a high value when the value V is high. Consequently, in the display unit 1, as described later, when a luminescent color of the pixel Pix is closer to a white color, the luminance becomes higher accordingly.

The Garea calculation section 92 calculates a parameter Garea for each pixel on the basis of the value V. The parameter Garea becomes smaller when the area of a bright region is larger in a frame image, and becomes larger when such area is smaller. As described later, the parameter Garea is used for the peak luminance expansion processing.

The Gbase calculation section 93 calculates a parameter Gbase for each frame image on the basis of the average luminance level APL and the average current level ACL. The Gbase calculation section 93 has a Gp calculation section 94, a Gc calculation section 95, a selection section 96, and a filter section 97.

The Gp calculation section 94 calculates a parameter Gp for each frame image on the basis of the average luminance level APL. As described later, the parameter Gp is used for the contrast adjustment processing. The Gp calculation section 94 has a lookup table and uses the lookup table to calculate the parameter Gp.

Figure 9:
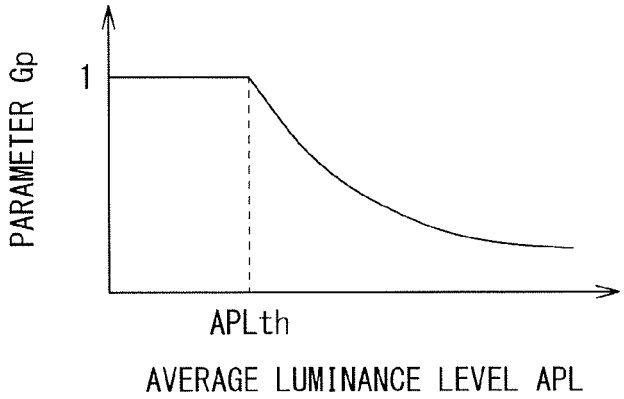
FIG. 9 is an explanatory diagram for describing a lookup table for an average luminance level acquisition section illustrated in FIG. 5.

FIG. 9 shows the characteristics of a lookup table in the Gp calculation section 94. On the lookup table in the Gp calculation section 94, in this example, the parameter Gp becomes "1" when the average luminance level APL is not more than a threshold APLth, and the parameter Gp decreases in inverse proportion to the average luminance level APL when the average luminance level APL is not less than the threshold APLth. Consequently, in the display unit 1, as described later, it is possible to change the contrast of a display image in accordance with the average luminance level APL.

The Gc calculation section 95 calculates a parameter Gc for each frame image on the basis of the average current level ACL. As described later, the parameter Gc is used for the overcurrent suppression processing. The Gc calculation section 95 has a lookup table and uses the lookup table to calculate the parameter Gc.

Figure 10:
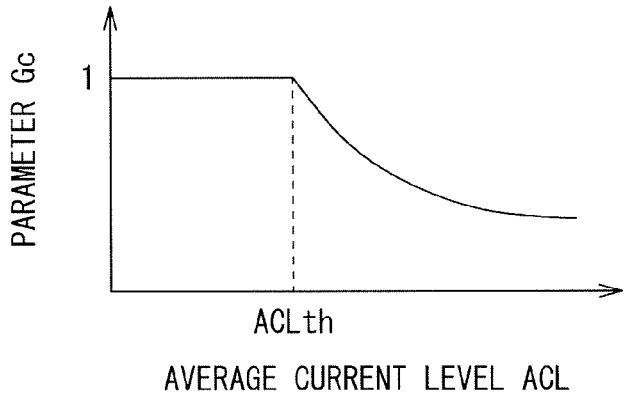
FIG. 10 is an explanatory diagram for describing a lookup table for an average current level acquisition section illustrated in FIG. 5.

FIG. 10 shows the characteristics of a lookup table in the Gc calculation section 95. On the lookup table in the Gc calculation section 95, in this example, as with the lookup table in the Gp calculation section 94, the parameter Gc becomes "1" when the average current level ACL is not more than a threshold ACLth, and the parameter Gc decreases in inverse proportion to the average current level ACL when the average current level ACL is not less than the threshold ACLth. In such a manner, the parameter Gc becomes a small value when the average current level ACL is high. Consequently, in the display unit 1, as described later, when the average current level ACL is high, it is possible to reduce a possibility that any overcurrent may flow through the organic EL display elements in the EL display section 13.

A magnitude relation of these parameters Gp and Gc varies depending on a frame image of interest. In concrete terms, for example, the parameter Gc may become smaller than the parameter Gp when the average current level ACL is high (Gc<Gp), and otherwise may become larger than the parameter Gp (Gc>Gp).

The selection section 96 selects a lower one between the parameters Gp and Gc for each frame image. In other words, for example, the selection section 96 selects and outputs the parameter Gc when the average current level ACL is high, and otherwise selects and outputs the parameter Gp.

The filter section 97 smoothes parameters related to a series of frame images that are provided from the selection section 96 to output those parameters as the parameter Gbase. More specifically, the filter section 97 may be configured of, for example, an IIR (Infinite Impulse Response) filter.

The filter section 97 is provided to reduce a possibility of deterioration in the image quality, for example, in the event of large variations in a series of frame images in between times. In other words, when the average luminance level APL and the average current level ACL are acquired from a certain frame image, and a gain Gup is calculated based on the acquired average luminance level APL and average current level ACL, this gain Gup is multiplied by the pieces of luminance information IR, IG, and IB related to a next frame image at earliest. That is, a frame image to be used in calculating the gain Gup and a frame image in which the gain Gup is multiplied are different from one another. Consequently, if the filter section 97 is not provided, there could be a possibility that an image may be distorted to cause deterioration in the image quality in the case where, for example, a switching takes place from an all-white frame image to an all-black frame image, or in any other case. The display unit 1 is provided with the filter section 97 to smooth parameters related to a series of frame images that are provided from the selection section 96, which allows a possibility of deterioration in the image quality to be reduced.

It is to be noted that when a frame memory is provided, and a configuration is made to ensure that a frame image to be used in calculating the gain Gup and a frame image in which the gain Gup is multiplied are the same, the filter section 97 may not be provided.

The Gup calculation section 98 calculates the gain Gup on the basis of the parameters Gv, Garea, and Gbase. More specifically, the Gup calculation section 98 calculates the gain Gup for each pixel on the basis of the parameters Gv, Gbase, and Garea using Expression (1) given below.

$$Gup=(1+Gv\times Garea)\times Gbase \quad (1)$$

In FIG. 5, the multiplier section 46 generates an image signal Sp22 by multiplying the pieces of luminance information IR, IG, and IB by the gain Gup that is calculated by the gain calculation section 45.

In FIG. 1, the color gamut conversion section 23 generates an image signal Sp23 by converting a color gamut and a color temperature that are represented by the image signal Sp22 into a color gamut and a color temperature of the EL display section 13. In concrete terms, the color gamut conversion section 23 may carry out the color gamut and color temperature conversion by performing 3×3 matrix conversion, for example. It is to be noted that in any application where the color gamut conversion is not necessary, such as the case where a color gamut of an input signal and a color gamut of the EL display section 13 are consistent with one another, the color temperature conversion may be only carried out by performing a processing by the use of a coefficient for correcting the color temperature.

The RGBW conversion section 24 generates an RGBW signal on the basis of the image signal Sp23 that is an RGB signal to output such a resulting RGBW signal as an image signal Sp24. In concrete terms, the RGBW conversion section 24 converts the RGB signal including the pieces of luminance information IR, IG, and IB for three colors of red (R), green (G), and blue (B) into the RGBW signal including pieces of luminance information IR3, IG3, IB3, and IW3 for four colors of red (R), green (G), blue (B), and white (W). The RGBW conversion section 24 carries out such a conversion processing operation in the same method as with the RGBW conversion section 43.

The gamma conversion section 25 converts the image signal Sp24 having the linear gamma characteristics into the image signal Sp1 having the nonlinear gamma characteristics corresponding to the characteristics of the EL display section 13. As with the gamma conversion section 21, the gamma conversion section 25 may have a lookup table and may use the lookup table to perform the gamma conversion.

Here, the EL display section 13 corresponds to a specific but not limitative example of a "display section" in one embodiment of the present disclosure. The pixel Pix corresponds to a specific but not limitative example of a "display pixel" in one embodiment of the present disclosure. The image processing section 20 and the display control section 12 correspond to a specific but not limitative example of a "control section" in one embodiment of the present disclosure. The pieces of luminance information IR, IG, and IB that are included in the image signal Sp21 correspond to a specific but not limitative example of "sub-luminance information" in "first luminance information" in one embodiment of the present disclosure. The average luminance level APL corresponds to a specific but not limitative example of "frame luminance information" in one embodiment of the present disclosure. The average current level ACL corresponds to a specific but not limitative example of "current information" in one embodiment of the present disclosure. The parameter Gp corresponds to a specific but not limitative example of a "first gain" in one embodiment of the present disclosure. The parameter Gc corresponds to a specific but not limitative example of a "second gain" in one embodiment of the present disclosure. The pieces of luminance information IR, IG, and IB that are included in the image signal Sp23 correspond to a specific but not limitative example of "sub-luminance information" in "second luminance information" in one embodiment of the present disclosure. The pieces of luminance information IR3, IG3, IB3, and IW3 that are included in the image signal Sp24 correspond to a specific but not limitative example of "sub-luminance information" in "third luminance information" in one embodiment of the present disclosure.

[Operation and Function]

Next, the description is provided on operation and function of the display unit 1 according to this embodiment of the present disclosure.

(Overview of Overall Operation)

First, the description is provided on an overview of overall operation for the display unit 1 with reference to FIG. 1, FIG. 5, and the like. The input section 11 generates the image signal Sp0 on the basis of an image signal to be provided from an external apparatus. The gamma conversion section 21 converts the incoming image signal Sp0 into the image signal Sp21 having the linear gamma characteristics.

The signal processing section 22 performs the peak luminance expansion processing, the contrast adjustment processing, and the overcurrent suppression processing for the pieces of luminance information IR, IG, and IB that are included in the image signal Sp21, thereby generating the image signal Sp22. More specifically, in the signal processing section 22, the value acquisition section 41 acquires the value V for each pixel on the basis of the pieces of luminance information IR, IG, and IB that are included in the image signal Sp21. The average luminance level acquisition section 42 determines an average value (average luminance level APL) of the pieces of luminance information IR, IG, and IB in a frame image on the basis of the pieces of luminance information IR, IG, and IB. The RGBW conversion section 43 generates the RGBW signal on the basis of the image signal Sp21 that is an RGB signal. The average current level acquisition section 44 determines an average value of a current (average current level ACL) that is assumed to flow through each organic EL display element when the EL display section 13 displays a frame image. The gain calculation section 45 calculates the gain Gup on the basis of the value V for each pixel, as well as the average luminance level APL and the average current level ACL for each frame. The multiplier section 46 generates the image signal Sp22 by multiplying the pieces of luminance information IR, IG, and IB by the gain Gup.

The color gamut conversion section 23 generates the image signal Sp23 by converting a color gamut and a color temperature that are represented by the image signal Sp22 into a color gamut and a color temperature of the EL display section 13. The RGBW conversion section 24 generates the RGBW signal on the basis of the image signal Sp23 that is an RGB signal to output such a resulting RGBW signal as the image signal Sp24. The gamma conversion section 25 converts the image signal Sp24 having the linear gamma characteristics into the image signal Sp1 having the nonlinear gamma characteristics corresponding to the characteristics of the EL display section 13. The display control section 12 performs a timing control of a display operation in the EL display section 13 in accordance with the image signal Sp1. The EL display section 13 carries out a display operation under control of the display control section 12.

Next, the description is provided on detailed operation of the signal processing section 22.

(About Peak Luminance Expansion Processing)

In the gain calculation section 45 (FIG. 7), the Gv calculation section 91 uses a function as shown in FIG. 8 to generate the parameter Gv for each pixel depending on the value V. The Garea calculation section 92 generates the parameter Garea for each pixel depending on the value V. Further, the Gup calculation section 98 calculates the gain Gup for each pixel on the basis of these parameters Gv and Garea using Expression (1).

Figure 11:
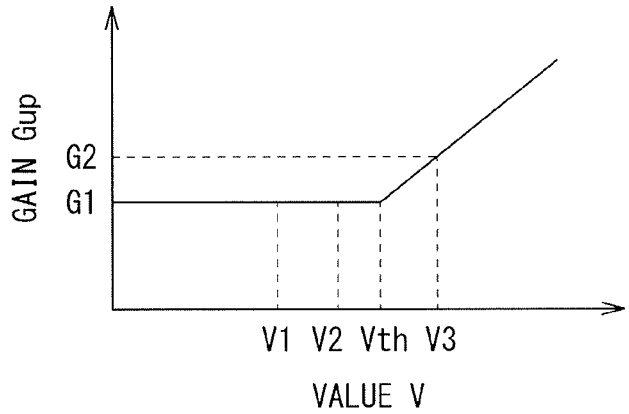
FIG. 11 is an explanatory diagram showing a characteristic example of the signal processing section.

FIG. 11 shows the characteristics of the gain Gup. It is to be noted that, in this example, the parameters Garea and Gbase are assumed to be constant for the sake of explanatory convenience. As with the gain Gv that is illustrated in FIG. 8, the gain Gup becomes a constant value when the value V is lower than a threshold Vth, and becomes larger with an increase in the value V when the value V is higher than the threshold Vth. In other words, the gain Gup becomes higher as a color represented by its pieces of luminance information IR, IG, and IB is closer to a white color. In the display unit 1, this expands the luminance of the pixel Pix that emits light of a color closer to a white color (peak luminance expansion processing).

Figure 12A:
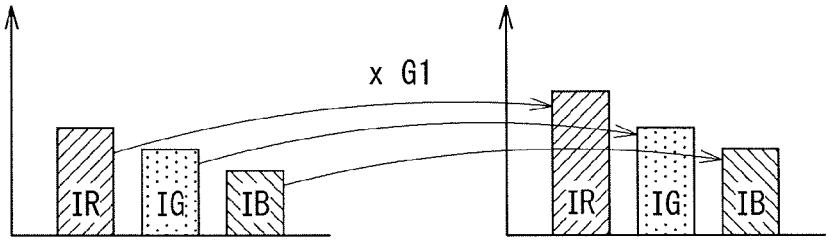
FIGS. 12A, 12B, and 12C are each an explanatory diagram showing an operation example of a peak luminance expansion processing.
Figure 12B:
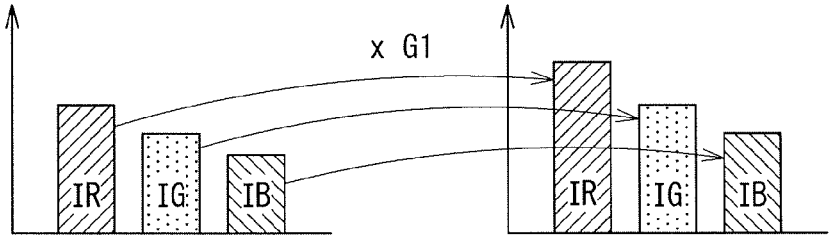
Figure 12C:
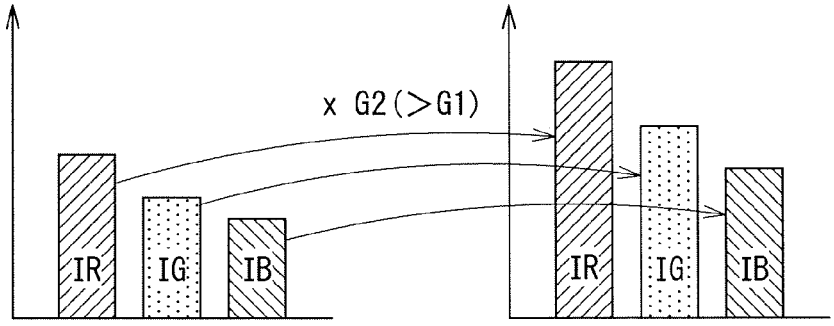

Each of FIGS. 12A, 12B, and 12C shows an example of the peak luminance expansion processing. Each of FIGS. 12A, 12B, and 12C illustrates operation at the values V1 to V3 as shown in FIG. 11, wherein FIGS. 12A, 12B, and 12C show the cases of the values V1, V2, and V3, respectively. As shown in FIG. 11, because the gain Gup is constant at a gain G1 when the value V is not more than the threshold Vth, the signal processing section 22 multiplies the pieces of luminance information IR, IG, and IB by the same gain G1 as shown in FIGS. 12A and 12B. On the other hand, as shown in FIG. 11, because the gain Gup is raised when the value V is not less than the threshold Vth, the signal processing section 22 multiplies the pieces of luminance information IR, IG, and IB by a gain G2 greater than the gain G1 as shown in FIG. 12C.

In such a manner, the signal processing section 22 expands the luminance by raising the gain Gup with an increase in the value V. This makes it possible to increase a dynamic range of an image signal. As a result, the display unit 1 is capable of displaying images with high contrast. For example, the display unit 1 is allowed to display stars more brightly in displaying an image of stars glittering in the sky, as well as to represent glazing of a metal in displaying any metal such as a coin.

The gain calculation section 45 determines the gain Gup using the parameter Garea in addition to the parameter Gv. The parameter Garea becomes smaller when the area of a bright region is larger in a frame image, and becomes larger when such area is smaller. As described above, in the display unit 1, the gain Gup varies depending on the parameter Garea, which allows the image quality to be enhanced as described below.

Figure 13:
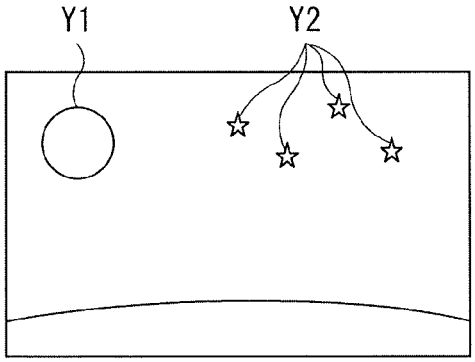
FIG. 13 is an explanatory diagram showing another operation example of the peak luminance expansion processing.

FIG. 13 illustrates an example of a display screen. This example shows an image where there are a full moon Y1 and a plurality of stars Y2 in the night sky. Assuming that the gain calculation section 45 calculates the gain Gup without using the parameter Garea, the signal processing section 22 expands the peak luminance for both of the pieces of luminance information IR, IG, and IB that configure the full moon Y1 and the pieces of luminance information IR, IG, and IB that configure the stars Y2 in this example. However, there could be a possibility that a viewer may get a better feeling of increased shining for the full moon Y1 with more surface area, while may get a less feeling of the effect of the stars Y2 due to the small areas thereof.

On the contrary, in the display unit 1, the gain Gup varies depending on the parameter Garea. In concrete terms, the parameter Garea becomes smaller when the area of a bright region is larger in a frame image, which leads to a decrease in the gain Gup in accordance with Expression (1). Similarly, the parameter Garea becomes larger when the area of a bright region is smaller, which leads to an increase in the gain Gup in accordance with Expression (1). As a result, in an example in FIG. 13, for the full moon Y1, expansion of the peak luminance is suppressed with a decrease in the parameter Garea because of the large area of a bright region, while for the stars Y2, the peak luminance is expanded because of the small area of a bright region. Consequently, this raises the luminance at a portion of the stars Y2 relatively, which makes it possible to enhance the image quality.

(Contrast Adjustment Processing and Overcurrent Suppression Processing)

In the gain calculation section 45, the Gp calculation section 94 calculates the parameter Gp for each frame image on the basis of the average luminance level APL. The Gc calculation section 95 calculates the parameter Gc for each frame image on the basis of the average current level ACL. The parameter Gc becomes a small value when the average current level ACL is high. The selection section 96 selects a lower one between the parameters Gp and Gc for each frame image. The filter section 97 smoothes parameters related to a series of frame images that are provided from the selection section 96 to output those parameters as the parameter Gbase. Further, the Gup calculation section 98 calculates the gain Gup on the basis of the parameter Gbase and the like using Expression (1).

On this occasion, when the selection section 96 selects the parameter Gc, in the display unit 1, a control is carried out to prevent any current flowing through the organic EL display elements on the pixel array section 33 of the EL display section 13 from becoming excessively large (overcurrent suppression processing). In other words, as shown in FIG. 10, when the average current level ACL is larger than the threshold ACLth, the parameter Gc decreases with an increase in the average current level ACL, which leads to a decrease in the gain Gup as well accordingly. As a result, this suppresses the pieces of luminance information IR, IG, and IB and therefore suppresses any current flowing through the organic EL display elements with an increase in the average current level ACL, which makes it possible to reduce a possibility that the overcurrent may flow through the organic EL display elements.

On the other hand, when the selection section 96 selects the parameter Gp, in the display unit 1, the image contrast is adjusted in accordance with the average luminance level APL (contrast adjustment processing). In other words, for example, when a display screen is dark (when the average luminance level APL is low), a viewer may get a less feeling of a difference in a gray scale of the luminance level at a portion with high luminance level within a display screen due to the low adaptation luminance of the viewer's eyes. On the contrary, when a display screen is bright (when the average luminance level APL is high), a viewer may get a better feeling of a difference in a gray scale of the luminance level at a portion with high luminance level within a display screen due to the high adaptation luminance of the viewer's eyes. In the display unit 1, for example, when a display screen is dark (when the average luminance level APL is low), the contrast is raised by increasing the parameter Gp and the gain Gup, thereby allowing a viewer to get a better feeling of a difference in a gray scale of the luminance level. Further, when a display screen is bright (when the average luminance level APL is high), the contrast is lowered by decreasing the parameter Gp and the gain Gup, thereby preventing a viewer from getting an excessive feeling of a difference in a gray scale of the luminance level. In such a manner, in the display unit 1, it is possible to improve the image quality by adjusting the image contrast in accordance with the average luminance level APL.

The parameter Gc becomes smaller than the parameter Gp when the average current level ACL is high, and otherwise becomes larger than the parameter Gp. Consequently, the selection section 96 selects and outputs the parameter Gc when the average current level ACL is high, and otherwise selects and outputs the parameter Gp. In other words, the selection section 96 selects the overcurrent suppression processing when the average current level ACL is high, and otherwise selects the contrast adjustment processing.

Figure 14:
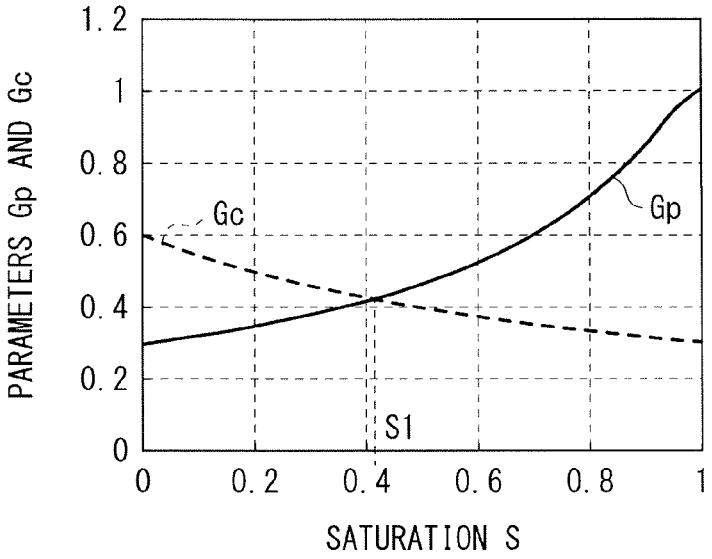
FIG. 14 is an explanatory diagram showing a characteristic example of a Gbase calculation section illustrated in FIG. 7.

FIG. 14 shows an example of the parameters Gp and Gc. FIG. 14 represents variations in the parameters Gp and Gc in the event of a change in the saturation (color saturation degree) S in the HSV color space. In this example, the saturation S is varied in the hue H of magenta. That is, the saturation S of 0 denotes a white color, and the saturation S of 1 denotes a magenta color.

As shown in FIG. 14, the parameter Gp becomes larger with an increase in a value of the saturation S. In other words, because a white color is greater than a magenta color in the value V, the average luminance level APL decreases by varying a display color from a white color toward a magenta color, leading to an increase in the parameter Gp accordingly as shown in FIG. 9. On the other hand, the parameter Gc becomes smaller with an increase in a value of the saturation S. In other words, the sub-pixel SPix of white (W) is luminescent in displaying a white color, and two sub-pixels SPix of red (R) and blue (B) are luminescent in displaying a magenta color. Consequently, by varying a display color from a white color toward a magenta color, the luminescence amount of the sub-pixel SPix of white (W) is lowered, and the luminescence amount of the two sub-pixels SPix of red (R) and blue (B) is raised, and thus the average current level ACL increases, leading to a decrease in the parameter Gc accordingly as shown in FIG. 10.

In this example, as shown in FIG. 14, the parameters Gp and Gc become the same value at the saturation S of 1, and a magnitude relation of the parameters Gp and Gc is changed at saturation S1 as a boundary. In other words, in this example, the parameters Gp is lower than the parameter Gc when the saturation S is lower than the saturation S1, and the parameters Gc is lower than the parameter Gp when the saturation S is larger than the saturation S1.

The selection section 96 selects a lower one between the parameters Gp and Gc. In other words, in an example in FIG. 14, the selection section 96 selects the parameter Gp when the saturation S is lower than the saturation S1, and selects the parameter Gc when the saturation S is higher than the saturation S1.

Figure 15:
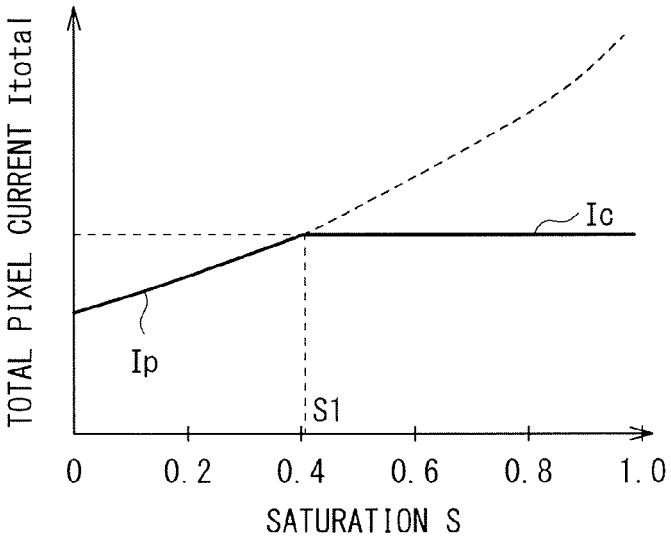
FIG. 15 is an explanatory diagram showing an operation example of the signal processing section illustrated in FIG. 1.

FIG. 15 shows a total pixel current Itotal representing a sum of the amount of current flowing through the organic EL display elements. Like FIG. 14, FIG. 15 shows variations in the total pixel current Itotal in the event of a change in the saturation (color saturation degree) S in the HSV color space. That is, the saturation S of 0 denotes a white color, and the saturation S of 1 denotes a magenta color. The property Ip is a property at the time when the selection section 96 selects the parameter Gp, and the property Ic is a property at the time when the selection section 96 selects the parameter Gc.

When the saturation S is lower than the saturation 51, the parameter Gp is selected, and thus the total pixel current Itotal becomes larger with an increase in a value of the saturation S as shown by the property Ip. In this case, the display unit 1 operates to enhance the image quality by adjusting the contrast in accordance with the average luminance level APL. Further, when the saturation S is higher than the saturation 51, the parameter Gc is selected, and thus the total pixel current Itotal becomes almost constant irrespective of a value of the saturation S as shown by the property Ic. In this case, the display unit 1 operates to suppress any overcurrent flowing through the organic EL display elements.

As described above, in the display unit 1, even when each pixel Pix is configured of four sub-pixels SPix of red (R), green (G), blue (B), and white (W), it is possible to reduce a possibility that any overcurrent may flow through the organic EL display elements, while enhancing the image quality.

In other words, when each pixel Pix is configured of three sub-pixels SPix of red (R), green (G), and blue (B), a current flowing through the pixel Pix in displaying a white color becomes the highest. Consequently, as described in Japanese Patent No. 4293747, it is possible to achieve the high contrast and suppression of any overcurrent at the same time by adjusting the light-emitting luminance on the basis of the total pixel current.

However, when each pixel Pix is configured of four sub-pixels SPix of red (R), green (G), blue (B), and white (W), if the light-emitting luminance is adjusted on the basis of only the total pixel current like Japanese Patent No. 4293747, it is likely that a defect will occur. In other words, in this configuration, a current flowing through the pixel Pix in displaying complementary colors (cyan, magenta, and yellow) becomes the highest. Consequently, for example, in displaying complementary colors, the total pixel current increases to suppress the light-emitting luminance, which leads to a decrease in the contrast. In such a manner, when each pixel Pix is configured of four sub-pixels SPix, if the light-emitting luminance is adjusted on the basis of only the total pixel current, there could be a possibility that it may be difficult to achieve both of the high contrast (high image quality) and suppression of any overcurrent.

On the contrary, in the display unit 1, because the gain Gup is determined on the basis of both the average luminance level APL and the average current level ACL, an overcurrent is suppressed when the average current level ACL is high, and otherwise the contrast is adjusted in accordance with the average luminance level APL, thereby allowing to improve the image quality.

Further, in the display unit 1, the signal processing section 22 is provided at a prestage of the RGBW conversion section 24, which makes it possible to enhance the image quality. In other words, typically for each of the sub-pixels SPix on the EL display section 13, it is likely that the chromaticity will vary depending on the signal level. Therefore, if the signal processing section 22 is provided at a post-stage of the RGBW conversion section 24, it is likely that the chromaticity of a display image will be mismatched. In addition, when an image processing is performed to avoid such a disadvantage, it is necessary to carry out a complicated processing in consideration of the nonlinearity. On the contrary, in the display unit 1, the signal processing section 22 is provided at a prestage of the RGBW conversion section 24, which makes it possible to reduce a possibility that the chromaticity of a display image may be mismatched.

Moreover, it is possible to achieve a simple configuration by providing the signal processing section 22 at a prestage of the RGBW conversion section 24 in such a manner. That is, because the average luminance level APL may be preferably acquired from the RGB signal instead of the RGBW signal, it is possible to acquire the average luminance level APL directly from the RGB signal without performing any signal conversion processing by providing the signal processing section 22 at a prestage of the RGBW conversion section 24.

[Effects]

As described above, in this embodiment of the present disclosure, in the signal processing section, the gain Gup is determined on the basis of both the average luminance level and the average current level, which makes it possible to achieve adjustment of the contrast and suppression of any overcurrent at the same time, as well as to enhance the image quality.

Further, in this embodiment of the present disclosure, each pixel may be configured of four sub-pixels of red, green, blue, and white, which allows power consumption to be reduced.

Additionally, in this embodiment of the present disclosure, in the signal processing section, there may be provided the filter section, which makes it possible to reduce a possibility of deterioration in the image quality.

Moreover, in this embodiment of the present disclosure, the signal processing section may be provided at a prestage of the RGBW conversion section, which makes it possible to enhance the image quality, as well as to achieve a simple configuration.

[Modification Example 1-1]

In the above-described embodiment of the present disclosure, the Gp calculation section 94 and the Gc calculation section 95 use lookup tables to calculate the parameters Gp and Gc, respectively, although a calculation method is not limited thereto. Alternatively, for example, these sections may use functions to calculate the parameters Gp and Gc, respectively.

(2. Second Embodiment)

Next, the description is provided on a display unit 2 according to a second embodiment of the present disclosure. In this embodiment of the present disclosure, a configuration is made to control a luminescent period of the pixel Pix on the basis of the average luminance level APL and the average current level ACL. It is to be noted that any component parts essentially same as those of the display unit 1 according to the above-described first embodiment are denoted with the same reference numerals, and the related descriptions are omitted as appropriate.

Figure 16:
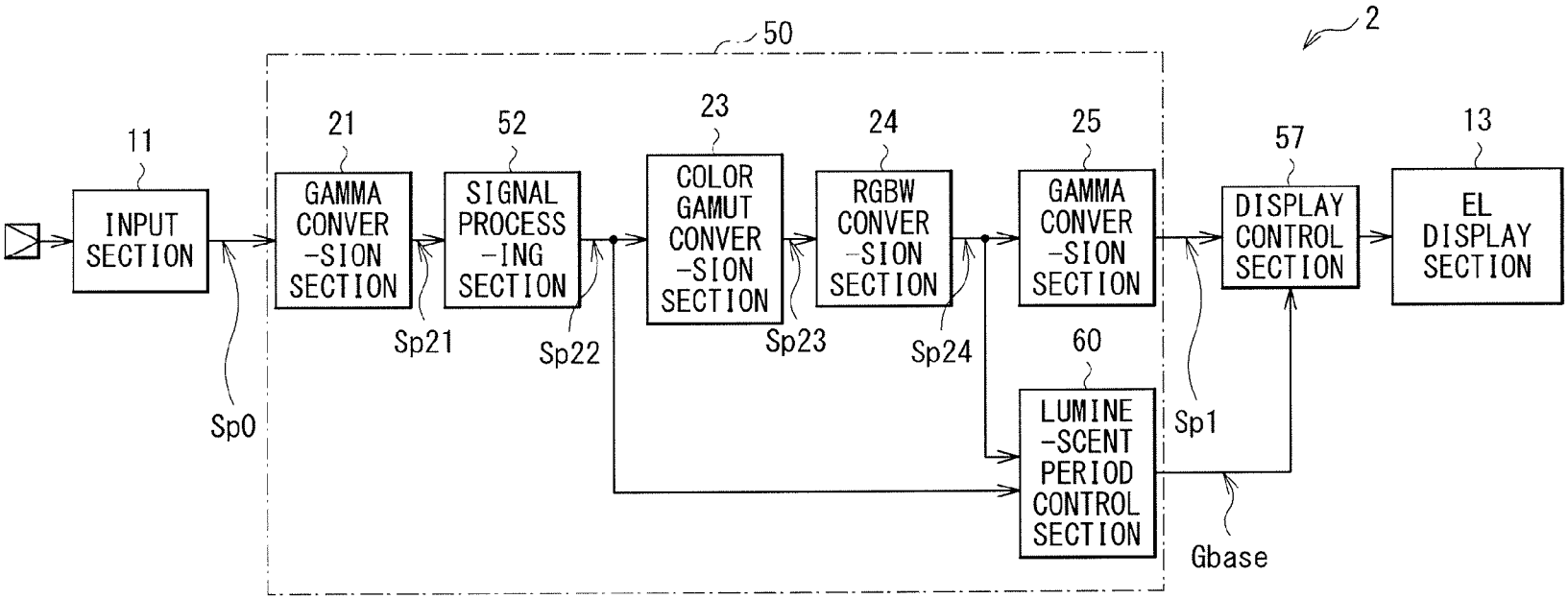
FIG. 16 is a schematic block diagram showing a configuration example of a display unit according to a second embodiment of the present disclosure.

FIG. 16 shows a configuration example of the display unit 2 according to this embodiment of the present disclosure. The display unit 2 includes an image processing section 50 and a display control section 57. The image processing section 50 has a signal processing section 52 and a luminescent period control section 60.

Figure 17:
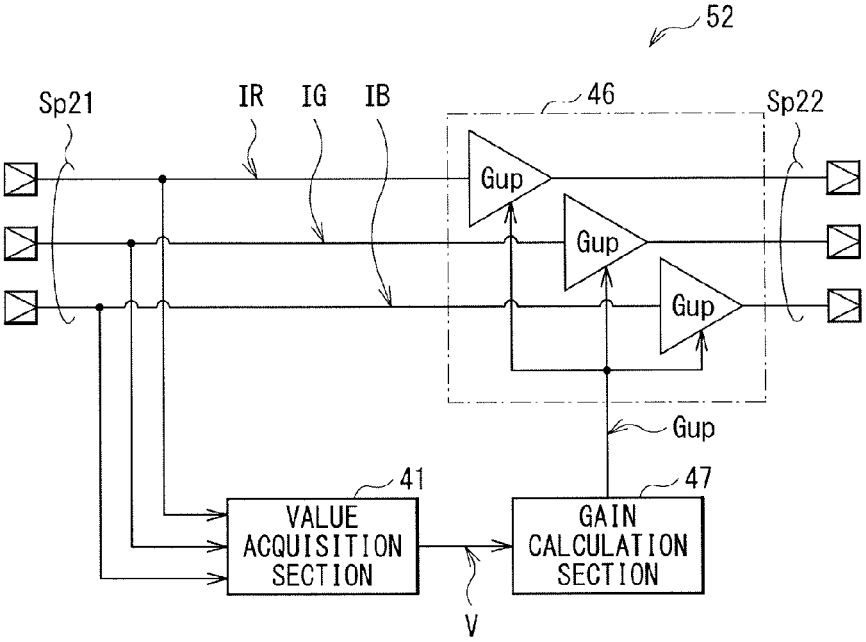
FIG. 17 is a schematic block diagram showing a configuration example of a signal processing section illustrated in FIG. 16.

FIG. 17 shows a configuration example of the signal processing section 52. The signal processing section 52 is configured by omitting the average luminance level acquisition section 42, the RGBW conversion section 43, and the average current level acquisition section 44 from the signal processing section 22 according to the first embodiment of the present disclosure (FIG. 5). The signal processing section 52 has a gain calculation section 47. The gain calculation section 47 calculates the gain Gup on the basis of the value V for each pixel that is provided from the value acquisition section 41. As with the gain calculation section 45 according to the first embodiment, the gain calculation section 47 determines the parameters Gv and Garea on the basis of the value V, and calculates the gain Gup for each pixel on the basis of these parameters Gv and Garea using Expression (2) given below.

$$Gup=1+Gv\times Garea \quad (2)$$

The luminescent period control section 60 determines the parameter Gbase on the basis of the image signal Sp22 that is the RGB signal and the image signal Sp24 that is the RGBW signal.

Figure 18:
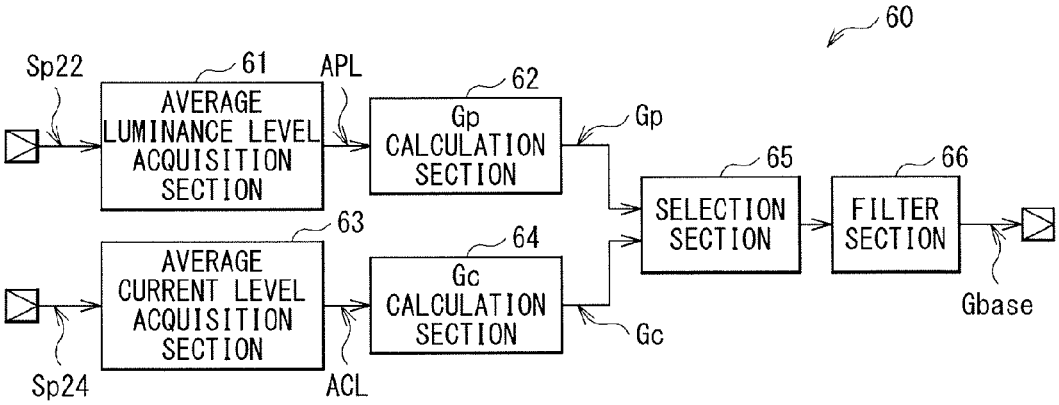
FIG. 18 is a schematic block diagram showing a configuration example of a light-emitting period control section illustrated in FIG. 16.

FIG. 18 shows a configuration example of the luminescent period control section 60. The luminescent period control section 60 has an average luminance level acquisition section 61, a Gp calculation section 62, an average current level acquisition section 63, a Gc calculation section 64, a selection section 65, and a filter section 66. As with the average luminance level acquisition section 42 according to the first embodiment, the average luminance level acquisition section 61 determines the average luminance level APL on the basis of the image signal Sp22 that is the RGB signal. Further, as with the average current level acquisition section 44 according to the first embodiment, the average current level acquisition section 63 determines the average current level ACL on the basis of the image signal Sp24 that is the RGBW signal. The Gp calculation section 62, the Gc calculation section 64, the selection section 65, and the filter section 66 have the same functions as the Gp calculation section 94, the Gc calculation section 95, the selection section 96, and the filter section 97, respectively according to the first embodiment.

The display control section 57 carries out a timing control of a display operation on the EL display section 13 on the basis of the image signal Sp1 and the parameter Gbase that is provided from the luminescent period control section 60. In concrete terms, the display control section 57 controls a duty ratio D indicating a rate of a luminescent period of each pixel Pix during a single frame period on the basis of the parameter Gbase in controlling the EL display section 13 in accordance with the image signal Sp1. On this occasion, the display control section 57 increases the duty ratio D when the parameter Gbase is high, and decreases the duty ratio D when the parameter Gbase is low.

Here, the pieces of luminance information IR3, IG3, IB3, and IW3 that are included in the image signal Sp24 correspond to a specific but not limitative example of "sub-luminance information" in "fourth luminance information" in one embodiment of the present disclosure.

As described above, in the display unit 2, it is possible to control the light-emitting luminance of the pixel Pix by controlling a luminescent period of the pixel Pix. In other words, in the display unit 1 according to the first embodiment of the present disclosure, the gain Gup is generated on the basis of the parameter Gbase, and a control is performed for the light-emitting luminance of the pixel Pix using this gain Gup, although in the display unit 2 according to this embodiment of the present disclosure, it is possible to control the light-emitting luminance of the pixel Pix by controlling a luminescent period of the pixel Pix on the basis of the parameter Gbase.

Even when a configuration is made to control the light-emitting luminance of the pixel by controlling a luminescent period of the pixel as described above, it is possible to obtain the same effects as with the above-described first embodiment of the present disclosure.

[Modification Example 2-1]

Figure 19:
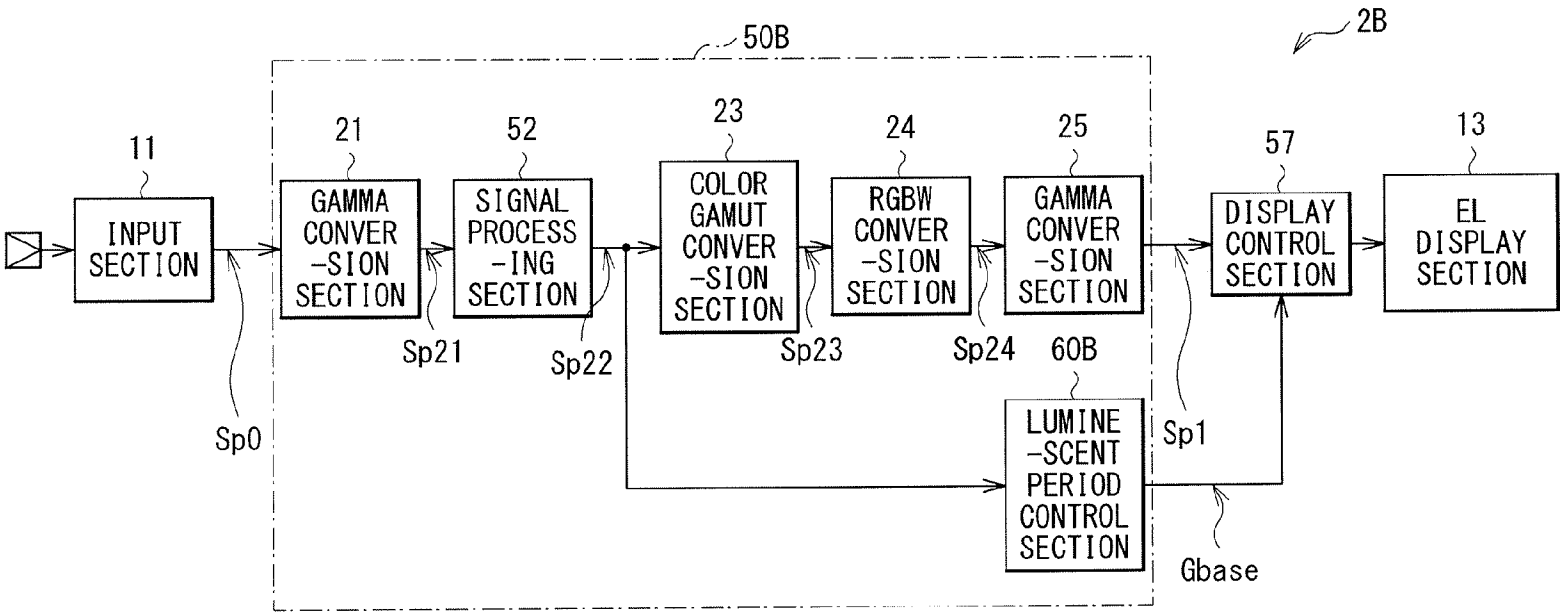
FIG. 19 is a schematic block diagram showing a configuration example of a display unit according to a modification example for the second embodiment of the present disclosure.
Figure 20:
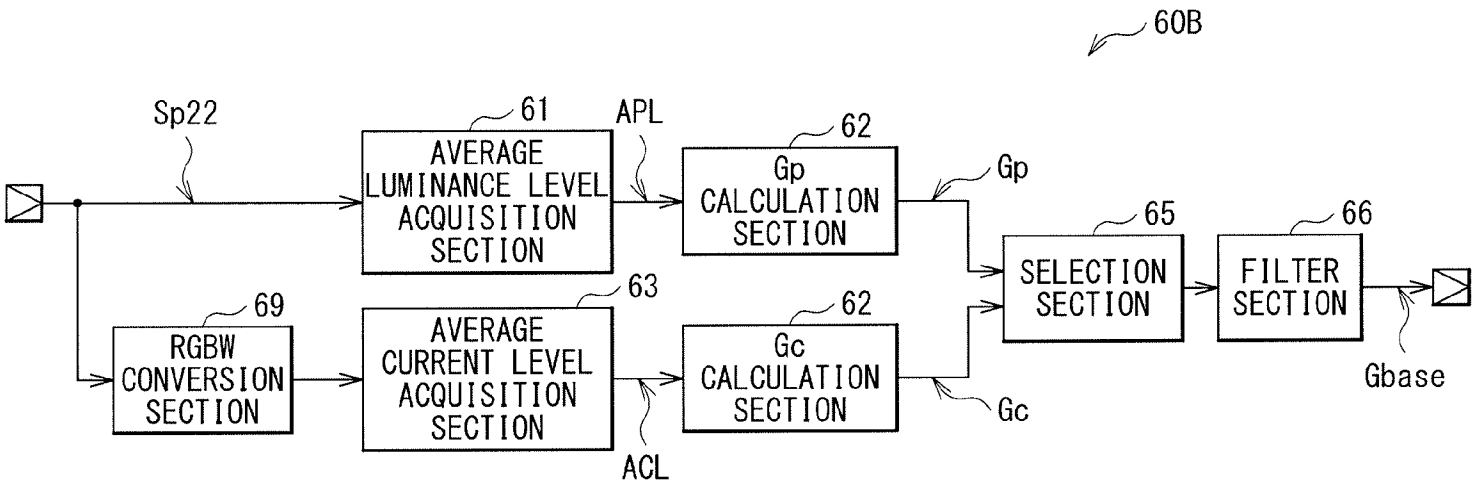
FIG. 20 is a schematic block diagram showing a configuration example of a light-emitting period control section illustrated in FIG. 19.

In the above-described embodiment of the present disclosure, the average current level acquisition section 63 acquires the average current level ACL on the basis of the image signal Sp24 that is provided from the RGBW conversion section 24, although a configuration is not limited thereto. Alternatively, for example, as shown in FIG. 19 and FIG. 20, the image signal Sp22 to be provided from the signal processing section 52 may be converted into the RGBW signal to acquire the average current level ACL on the basis of such a signal for which the RGBW conversion is performed. This display unit 2B has an image processing section 50B having a luminescent period control section 60B. The luminescent period control section 60B has an RGBW conversion section 69. The RGBW conversion section 69 performs the RGBW conversion for the image signal Sp22 that is the RGB signal to generate the RGBW signal. The average current level acquisition section 63 acquires the average current level ACL on the basis of this RGBW signal.

(3. Application Examples)

Next, the description is provided on application examples of the display units that are described in the above-mentioned embodiments and the modification examples thereof of the present disclosure.

Figure 21:
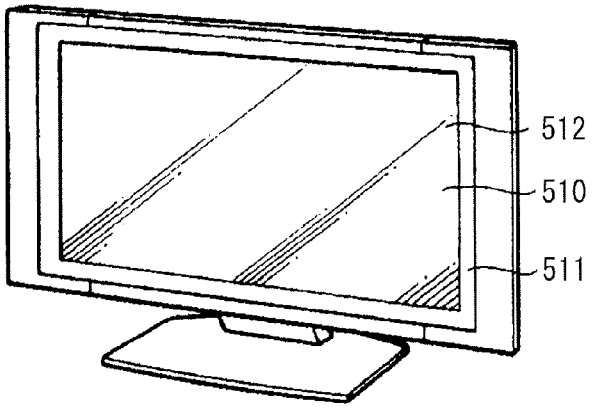
FIG. 21 is a perspective view showing an external appearance of a television receiver to which the display unit according to any of the embodiments and the modification examples of the present disclosure is applicable.

FIG. 21 shows an external view of a television receiver to which any of the display units according to the above-mentioned embodiments and the like of the present disclosure is applicable. This television receiver may have, for example, an image display screen section 510 including a front panel 511 and a filter glass 512. This television receiver includes any of the display units according to the above-mentioned embodiments and the like of the present disclosure.

The display units according to the above-mentioned embodiments and the like of the present disclosure are applicable to electronic apparatuses in every field, such as a digital camera, a notebook personal computer, a mobile terminal including a mobile phone, a portable game machine, or a video camera in addition to such a television receiver. In other words, the display units according to the above-mentioned embodiments and the like of the present disclosure are applicable to electronic apparatuses in every field that display images.

The present technology is described thus far with reference to some embodiments and modification examples as well as the application examples for electronic apparatuses, although the present technology is not limited to the above-described embodiments and the like, but different variations are available.

Figure 22:
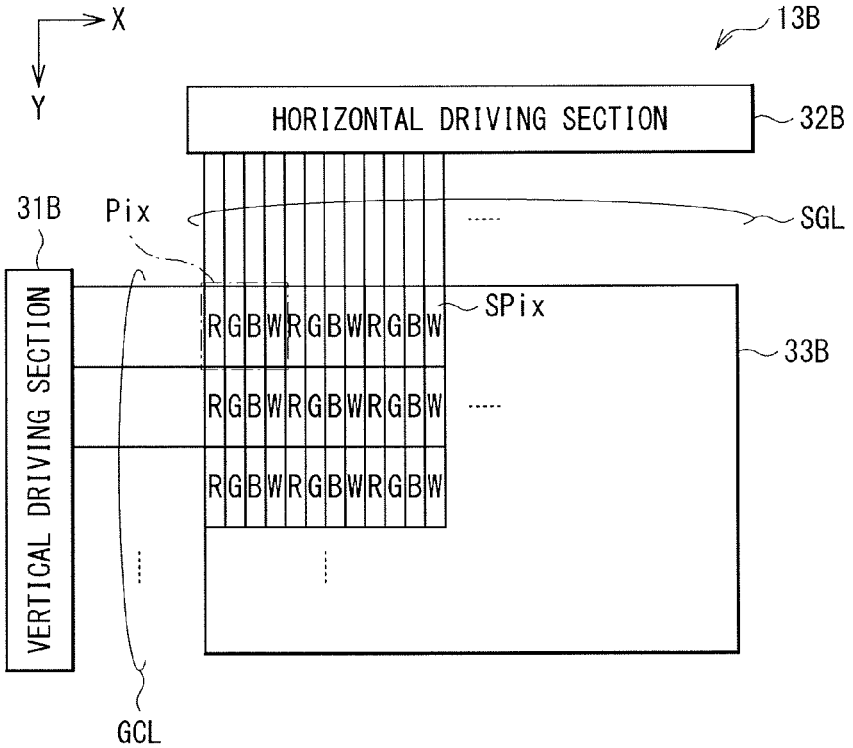
FIG. 22 is a schematic block diagram showing a configuration example of an EL display section according to a modification example.

For example, in each of the above-described embodiments and the like, on the pixel array section 33 of the EL display section 13, four sub-pixels SPix are arranged in a two-row-two-column pattern to configure the pixel Pix, although a configuration is not limited thereto. For example, the pixel Pix may be configured by arranging four sub-pixels SPix extending in a vertical direction Y in a side-by-side style in a horizontal direction X as shown in FIG. 22. In this example, the sub-pixels SPix may be arranged in the order of red (R), green (G), blue (B), and white (W) from the left side in the pixel Pix.

Furthermore, the technology encompasses any possible combination of some or all of the various embodiments described herein and incorporated herein.

It is possible to achieve at least the following configurations from the above-described example embodiments of the disclosure.

(1) A display unit, including:

a display section including a plurality of display pixels; and a control section configured to determine, based on first luminance information for each of the display pixels, frame luminance information in a single frame and current information, the current information indicating a magnitude of a current that is expected to be consumed in displaying the single frame on the display section, and control, based on the frame luminance information and the current information, light-emitting luminance of the display section.

(2) The display unit according to (1), wherein the control section selectively switches between a first control and a second control, the first control controlling the light-emitting luminance, based on the frame luminance information, and the second control controlling the light-emitting luminance, based on the current information.

(3) The display unit according to (2), wherein the control section determines a first gain from the frame luminance information and a second gain from the current information, and selects the first control to control, based on the first gain, the light-emitting luminance when the first gain is lower than the second gain, and selects the second control to control, based on the second gain, the light-emitting luminance when the second gain is lower than the first gain.

(4) The display unit according to (3), wherein each of the display pixels includes a first sub-pixel, a second sub-pixel, a third sub-pixel, and a fourth sub-pixel, the first sub-pixel, the second sub-pixel, the third sub-pixel emitting respective three key color light beams, and the fourth sub-pixel emitting a light beam of a color different from each of the light beams of the respective first sub-pixel, the second sub-pixel, and the third sub-pixel.

(5) The display unit according to (4), wherein the first luminance information includes three pieces of sub-luminance information corresponding to the respective first sub-pixel, the second sub-pixel, and the third sub-pixel, and the control section determines second luminance information, based on the first luminance information and one of the first gain and the second gain, and controls the light-emitting luminance, based on the second luminance information.

(6) The display unit according to (5), wherein the control section determines, based on the second luminance information, third luminance information that includes four pieces of sub-luminance information corresponding to the respective first sub-pixel, the second sub-pixel, the third sub-pixel, and the fourth sub-pixel, and controls the light-emitting luminance, based on the third luminance information.

(7) The display unit according to (4), wherein the control section controls the light-emitting luminance by varying a rate of a luminescent period of each of the display pixels during a single frame period, based on one of the first gain and the second gain.

(8) The display unit according to (7), wherein the first luminance information includes three pieces of sub-luminance information corresponding to the respective first sub-pixel, the second sub-pixel, and the third sub-pixel, and the control section determines, based on the first luminance information, fourth luminance information that includes four pieces of sub-luminance information corresponding to the respective first sub-pixel, the second sub-pixel, the third sub-pixel, and the fourth sub-pixel, and determines the current information, based on the fourth luminance information.

(9) The display unit according to (2), wherein the control section selects the first control when a first total pixel current of the display pixels upon performing the first control is expected to be lower than a second total pixel current of the display pixels upon performing the second control, and selects the second control when the first total pixel current is expected to be larger than the second total pixel current.

(10) The display unit according to any one of (1) to (9), wherein the control section acquires, based on the first luminance information, one of V information in an HSV color space and L information in an HLS color space, and determines the frame luminance information, based on that one of the V information and the L information.

(11) The display unit according to any one of (1) to (10), wherein the display section is an electroluminescence display section.

(12) A display unit, including:

a display section including a plurality of display pixels; and a control section configured to control light-emitting luminance of the display section to allow a total pixel current of the display pixels to be increased with an increase in S information in an HSV color space when the S information is equal to or less than a predetermined value, the S information being derived from luminance information for each of the display pixels, and to allow the total pixel current to be substantially constant when the S information is equal to or more than the predetermined value.

(13) An image processing device, including a control section configured to determine, based on first luminance information for each display pixel, frame luminance information in a single frame and current information, the current information indicating a magnitude of a current that is expected to be consumed in displaying the single frame on a display section, and control, based on the frame luminance information and the current information, light-emitting luminance of the display section.

(14) A display method, including:

determining, based on first luminance information for each display pixel, frame luminance information in a single frame and current information, the current information indicating a magnitude of a current that is expected to be consumed in displaying the single frame on a display section; and controlling, based on the frame luminance information and the current information, light-emitting luminance of the display section.

(15) An electronic apparatus provided with a display unit and a control section configured to perform a control of operation on the display unit, the display unit including:

a display section including a plurality of display pixels; and a control section configured to determine, based on first luminance information for each of the display pixels, frame luminance information in a single frame and current information, the current information indicating a magnitude of a current that is expected to be consumed in displaying the single frame on the display section, and control, based on the frame luminance information and the current information, light-emitting luminance of the display section.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

an electro-luminescence display including a plurality of light-emitting pixels, wherein each pixel of the plurality of light-emitting pixels comprises a red sub-pixel, a green sub-pixel, a blue sub-pixel, and a white sub-pixel; and circuitry configured to:

generate output image data based on an image processing on input image data of an image;

determine a gain value based on a first luminance information value and current information, wherein the first luminance information value is a portion of the input image data corresponding to a specific pixel of the plurality of light-emitting pixels, and the current information indicates a magnitude of current that is consumed for display of the output image data;

determine a second luminance information value based on the first luminance information value and the gain value, wherein the second luminance information value is a portion of the output image data corresponding to the specific pixel of the plurality of light-emitting pixels; and increase the gain value based on:

a decrease of an area of an image object in the image, wherein the specific pixel belongs to the area of the image object; and an increase of the first luminance information value relative to an average value of the input image data, wherein the average value of the input image data corresponds to a specific region of the image, and the specific region is larger than the area of the image object.

2. The display apparatus according to claim 1, wherein the first luminance information value is based on red luminance information, green luminance information, and blue luminance information.

3. The display apparatus according to claim 1, wherein the green sub-pixel is adjacent to the blue sub-pixel.

4. The display apparatus according to claim 1, wherein the circuitry is further configured to increase the gain value based on an increase in a pixel luminance value in a range where the pixel luminance value is at least equal to a threshold pixel luminance value, and the pixel luminance value is derived from the first luminance information value.

5. The display apparatus according to claim 4, wherein the circuitry is further configured to:

determine the gain value based on a gain function that represents a relationship between the pixel luminance value and the gain value; and increase the gain value at a specific gradient based on the increase in the pixel luminance value, in the gain function.

6. The display apparatus according to claim 4, wherein the circuitry is configured to increase the threshold pixel luminance value based on an increase in an average of the first luminance information value in a frame image.

7. The display apparatus according to claim 4, wherein the pixel luminance value corresponds to a value of Value information in an HSV color space.

8. The display apparatus according to claim 1, wherein the second luminance information value includes a red luminance value corresponding to the red sub-pixel, a green luminance value corresponding to the green sub-pixel, a blue luminance value corresponding to the blue sub-pixel, and a white luminance value corresponding to the white sub-pixel.

9. The display apparatus according to claim 8, wherein the circuitry is further configured to determine at least one of the red luminance value, the green luminance value, or the blue luminance value based on the gain value.

10. The display apparatus according to claim 8, wherein the circuitry is further configured to determine the white luminance value based on the gain value.

11. The display apparatus according to claim 8, wherein the circuitry is further configured to determine each of the red luminance value, the green luminance value, the blue luminance value, and the white luminance value based on the gain value.

12. The display apparatus according to claim 1, wherein the second luminance information value comprises four pieces of second sub luminance information value, and each of the four pieces of the second sub luminance information value corresponds to respective one of the red sub-pixel, the green sub-pixel, the blue sub-pixel, or the white sub-pixel.

13. The display apparatus according to claim 12, wherein the circuitry is further configured to execute color gamut conversion based on the second luminance information value.

14. The display apparatus according to claim 1, wherein the circuitry is further configured to:

acquire saturation information in an HSV color space from the first luminance information value; and correct the gain value that reduces based on an increase in the saturation information.

15. The display apparatus according to claim 1, wherein the circuitry is further configured to correct the gain value that reduces based an increase in an average of the first luminance information value in a frame image.

16. The display apparatus according to claim 1, wherein a first luminosity factor of color light emitted by the white sub-pixel is at least equal to a second luminosity factor for the green sub-pixel.

17. The display apparatus according to claim 1, wherein the white sub-pixel is adjacent to the blue sub-pixel.

18. The display apparatus according to claim 1, wherein the circuitry is further configured to increase the gain value as a color indicated by the first luminance information value of each of the red sub-pixel, the green sub-pixel, and the blue sub-pixel is closer to white.

19. An image processing apparatus, comprising:

a display panel including a plurality of pixels, wherein each pixel of the plurality of pixels comprises a red sub-pixel, a green sub-pixel, a blue sub-pixel, and a white sub-pixel; and circuitry configured to:

generate display image data based on an image processing on input image data of an image;

determine a gain value based on a first luminance information value and current information, wherein the first luminance information value is a portion of the input data image corresponding to a specific pixel of the plurality of pixels, and the current information indicates a magnitude of a current that is consumed for display of the display image data;

generate a second luminance information value based on the first luminance information value and the gain value, wherein the second luminance information value is a portion of the display image data corresponding to the specific pixel; and increase the gain value based on:

a decrease of an area of an image object in the image, wherein the specific pixel belongs to the area of the image object; and an increase of the first luminance information value relative to an average value of the input image data, wherein the average value of the input image data corresponds to a specific region of the image, and the specific region is larger than the area of the image object.

* * * * *